United States Patent [19]

Petrousky et al.

[11] Patent Number: 4,955,939

[45] Date of Patent: Sep. 11, 1990

[54] SHAPED CHARGE WITH EXPLOSIVELY DRIVEN LIQUID FOLLOW THROUGH

[75] Inventors: James A. Petrousky, Port Tobacco, Md.; Joseph E. Backofen; Donald J. Butz, both of Columbus, Ohio

[73] Assignee: The United States of America as represented by the Secretary of the Navy, Washington, D.C.

[21] Appl. No.: 471,381

[22] Filed: Mar. 2, 1983

[51] Int. Cl.[5] ..... F42B 12/10

[52] U.S. Cl. ..... 102/476; 102/306; 102/307; 102/308; 102/309; 102/310

[58] Field of Search ..... 102/306–310, 102/476; 86/1 B, 1.1; 89/1 A, 1.11

[56] References Cited

U.S. PATENT DOCUMENTS

| | | | |
|---|---|---|---|
| 1,913,015 | 6/1933 | Vadoz . | |
| 3,103,882 | 9/1963 | Gilliland . | |
| 3,117,518 | 1/1964 | Porter et al. | 102/307 |
| 3,162,121 | 12/1964 | Crawford | 102/306 |
| 3,188,955 | 6/1965 | Brown | 102/306 |
| 3,190,219 | 6/1965 | Venghiattis | 102/306 |
| 3,561,361 | 2/1971 | Kessenich | 102/307 |
| 4,065,005 | 9/1977 | McDanolds et al. | 86/1 B |
| 4,109,575 | 8/1978 | Hashimoto . | |
| 4,169,403 | 10/1979 | Hanson | 86/1 B |
| 4,170,940 | 10/1979 | Precoul | 102/476 |

*Primary Examiner*—Charles T. Jordan
*Assistant Examiner*—Richard W. Wendtland
*Attorney, Agent, or Firm*—Kenneth E. Walden; Donald J. Breh

[57] ABSTRACT

Disclosed is a non-fragmenting explosive device for perforating a target and injecting a material through the perforation to disrupt structure behind the target. The device is particularly adapted to safely disarm unexploded explosive devices such as bombs without detonation of the bomb. The device includes an outer covering of explosive material for explosively confining the disruptive material to a well defined shape for total injection into the target.

1 Claim, 2 Drawing Sheets

SHAPED CHARGE WITH EXPLOSIVELY DRIVEN LIQUID FOLLOW THROUGH

BACKGROUND OF THE INVENTION

This invention relates to explosive perforation devices. More particularly the invention relates to an explosive perforation device that utilizes the shaped charge principle in order to perforate a target and inject a material through the perforation for disrupting structures behind the target. The present invention is particularly adapted to disarm other explosive devices such as bombs without detonation of the bomb.

Heretofore, when it has been required to dispose of hazardous devices such as unexploded bombs it has been necessary to either actually detonate the bomb or to render it inactive by use of various techniques; one of which is by drilling a hole therein and inserting a material, such as water, into the interior of the interior of the explosive device. When actually detonating the explosive device, generally it must be relocated to an area that can sustain the explosion without endangering the surrounding area or personnel. When disarming an explosive device by physically making an opening and then inserting a disruptive material therein the danger of explosion is great due to metallic fragments and sparks created by the entry mechanism. Often times the explosive device to be deactivated may be located in a place from which it can not be removed or, such that movement would present a formidable task and danger. In such cases the bomb obviously can not be exploded and present methods of deactivation can be extremely hazardous. It is therefore highly desirable to have means of remotely penetrating the bomb and injecting a disruptive material for deactivation of any detonator means therein while reducing the threat of possible detonation from that when present devices are used.

Perforation devices have been devised that utilize shape charge principles and means for inserting a liquid through the perforation for disrupting structure behind the target. Such a device is disclosed in A. Venghiattis U.S. Pat. No. 3,190,329 for Perforating Device. However, contrary to the present invention, this device does not use shaped charge principles. While this device is suitable for penetration and insertion of a disruptive material, it is not suited for use in disarming hazardous devices because it does not eliminate the threat of detonation. Devices as disclosed by Vanghiattis will fragment and send metallic particles from the liner and case into the target along with the disruptive material. As previously stated, these metallic fragments can cause an explosive device to detonate. Additionally, because the walls or the case of such devices fragment due to the internal pressures created, the liquid material is not driven forward in a well defined path. Rather, the stream of liquid tends to expand radially away from the trajectory required to insert the material into the perforation. Consequently, a substantial portion of the disruptive material will merely splatter around the perforation.

The shortcomings of the A. Venghiattis' Perforating Device are not a significant problem when the device is used for its intended purpose of perforating well casings and disrupting the structure therebehind. In such application the device is placed in intimate contact with the target which assures eventual insertion of the material.

Fragmentation is also a desired effect for loosening densely packed material behind the target.

On the other hand, when perforating thick steel casings of bombs, the explosive powered device is normally located at a distance from the target so as to generate efficient jet for penetration and perforation without transmitting the direct shock of the explosion, thereby requiring means for assuring that the disruptive material is propelled in as straight and well defined a trajectory and configuration as possible.

To prevent fragmentation and to direct the disruptive material has heretofore required extremely thick case walls. This is undesirable because the size, weight, cost, and managability of such devices becomes unreasonable.

SUMMARY OF THE INVENTION

Accordingly, it is an object of the invention to provide for a device that will disrupt an explosive device such as a bomb without detonating the bomb.

Another object of the invention is to provide for an explosive perforation device that will not fragmentate when detonated.

A further object of the invention is to provide for an explosive perforation device having the capability of propelling a disruptive material in a well defined shape so that all of the disruptive material enters the perforation made in the target.

The objects of the invention are achieved and the shortcomings of the prior art are overcome by providing for a shaped charge device containing a disruptive material to be inserted into the target held between an explosive and a non-metallic shaped charge liner. The device further includes a second explosive covering a non-metallic case as the reacting explosive component for focusing and propelling the disruptive material. The covering explosive creates the effect of an infinitely thick wall which confines the disruptive material to a well defined shape and directs the material along a trajectory assuring insertion through the perforation made in the target by the shaped charge jet. Fragmentation is eliminated by disintegration of the case during detonation of the covering explosive and by utilizing a non-metallic shaped charge liner.

DETAILED DESCRIPTION OF THE PREFERRED EMBODIMENT

Figure 1A:
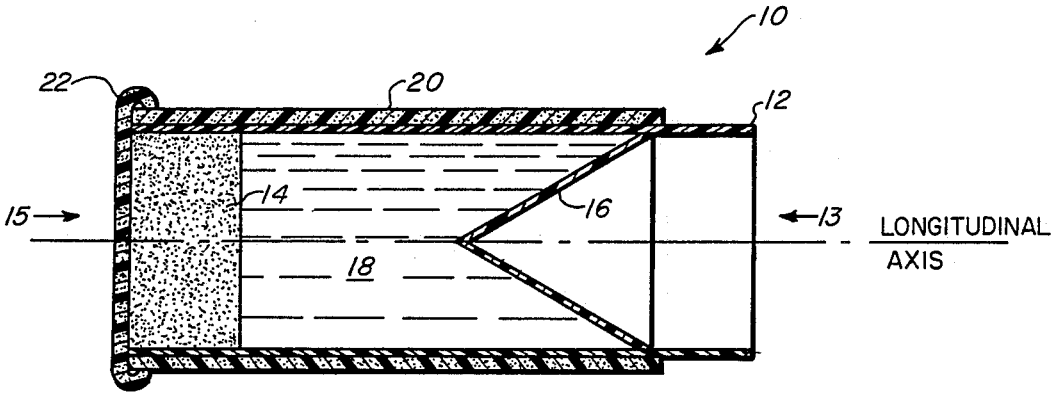
FIG. 1A a is transverse longitudinal cross-section of a preferred embodiment of the invention showing details of construction.

Shown in FIG. 1A is a preferred embodiment of an explosive perforation device of the present invention including an elongated case 12. The preferred case is hollow and tubular in shape but may be hemispherical or non-cylindrical and made of a plastic material. Plastic material is preferred because it will be consumed in the detonation process, but glass or brittle ceramic may also be used eliminating any fragmentation thereof which could occur with metallic materials. Glass and ceramic cases will be turned into fine powder. Plastic materials are also desirable from a reduced weight with accompanying ease of handling standpoint. The plastic material is able to withstand the forces created within the casing and confine the contents for the reasons set out hereinbelow. One end 13 of casing 12 is closed with a liner 16 also made of a non-metallic and preferrably of a plastic material to eliminate the introduction of metallic particles into a target 32, see FIG. 1E. Liner 16 is located adjacent to end 13 and is secured to the case interior surface so as to form a fluid tight seal. Liner 16 is formed into any of the well known shapes applicable to forming shaped charge jets for penetrating the specific target material and thickness. A first internal explosive material 14 is located within case 12 at an opposite end 15 and acts to close the case and form a cavity for holding a force transmitting, target disruptive material 18. The specific composition of internal explosive 14 depends on the shape of liner 16 and the target to be penetrated. Those skilled in shaped charges are familar with the specific design parameters to be considered in choosing the proper explosive composition 14 and liner shape. One common explosive that has been found to be acceptable in practice is what is commonly called composition C-4 which is plastic explosive comprised of 91% RDX (cyclotrimethylene trinitramine) and plasticizer. One liner shape found to be acceptable in practice is a funnel shape having its apex protruding into the disruptive material.

Figure 1B:
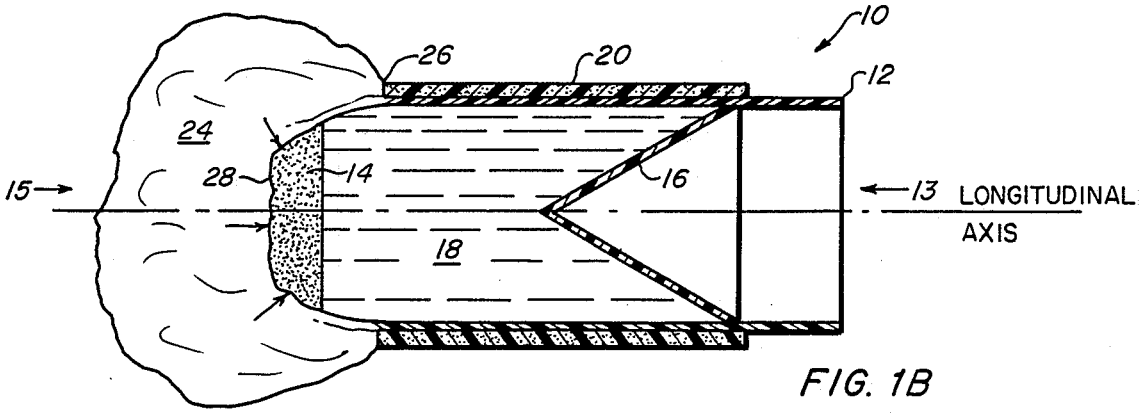
FIG. 1B is a transverse longitudinal cross section of the preferred embodiment in use just after initial detonation.
Figure 1C:
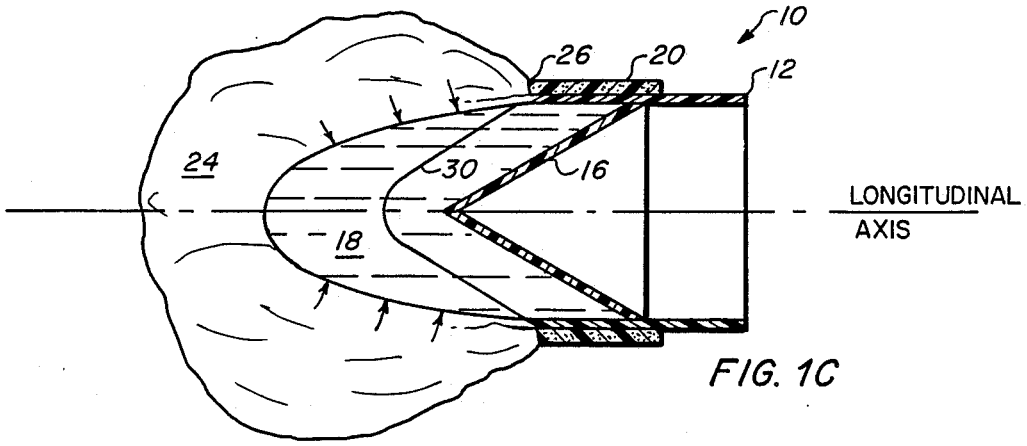
FIG. 1C is a transverse longitudinal cross-section of the preferred embodiment in use at an intermediate time after detonation showing details of operation.
Figure 1D:
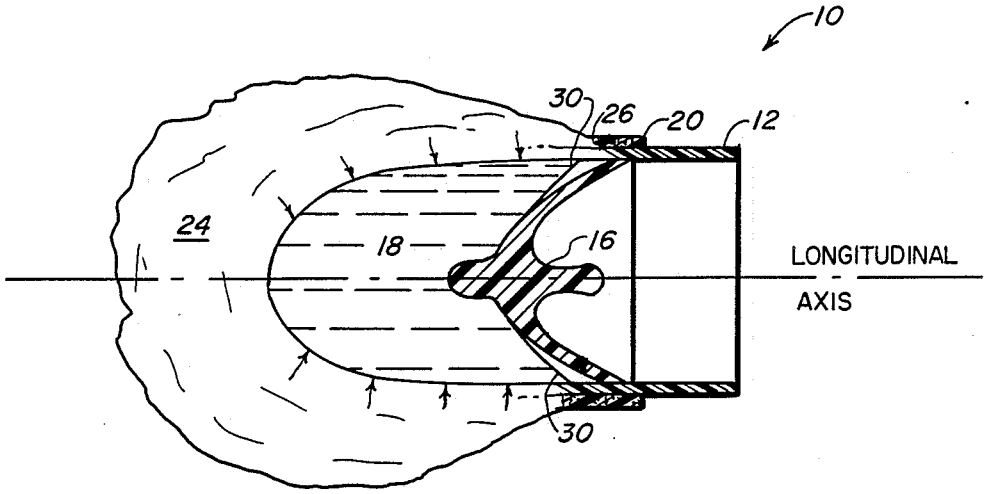
FIG. 1D is a transverse longitudinal cross-section of the preferred embodiment in use at a still later time after detonation showing details of operation.

Material 18 transmits the force and shockwave 30, see FIG. 1C, created by the explosion of explosive 14 to the liner, see FIG. 1D. In addition, material 18 is propelled forward along essentially a straight line trajectory that follows the shaped charge jet toward the target. It is contemplated that this invention is particularly adapted to disarming bombs and therefore a liquid disruptive material 18 is preferrable. Water is effective in disrupting bomb internal mechanisms and is therefore a preferred material. However, other materials, including gelatinous or solid materials, such as plastics having low melting points, that will liquidify or gasify when subjected to the heat and shock pressure due to the detonation of the explosive, are also applicable. Water, latex paints, and gelatins have been demonstrated to be effective in practice. Whatever the material used, the principal requirement is that it should flow like a liquid when subjected to the detonation heat and pressure, and have the desired disruptive effects on the target.

As shown in FIG. 1A, case 12 has an outer covering layer of a second explosive material 20 that completely encircles the case circumferential surface and extends longitudinally along the case from the end housing the internal explosive to the point of attachment of the liner. The exposed surface of internal explosive 14 is also covered with a layer 22 of the same explosive as that covering the case. FIG A shows covering explosives 20, 22 as two separate pieces, however, they can be made as one continuous explosive covering if desired. Whatever assembly technique is used, the explosive covering must completely surround the case and its contents. The covering explosive is preferably in sheet form. One sheet form of explosive found to be well suited for this device is flexible sheet explosive comprised of RDX, nitrocellulose and plasticizers. Also acceptable are proprietary sheet explosives which use PETN (Pentaerythride tetranitrate) as the main ingredient. The forces exerted inwardly on the disruptive material, as indicated by the arrows in FIG. 1A, 1C, 1D, when the covering explosive is detonated, must be equal to or greater than the forces exerted outwardly by the internal explosive. When the forces are so balanced, the effect of an infinitely thick case wall is created, thereby confining disruptive material 18 to essentially its original well defined shape and preventing it from expanding radially away from the longitudinal axis of the device. Material 18 is propelled and confined by the internal explosive force along the longitudinal axis and is confined radially by the covering explosive forces to remain in substantially the initial well defined shape capable of passing through a perforation 33 made in target 32 by the liner, see FIG. 1E.

PREFERRED MODE OF OPERATION

When it is desired to perforate the target and inject the disruptive material therein, the device is positioned in front of the desired point of entry at a distance sufficient to generate a jet to penetrate the target. When positioned, the covering explosive and internal explosive are simultaneously detonated by conventional means, not shown, such as electrical ignition means. The sequence of events after ignition is represented in the drawings.

Referring to FIG. 1B the covering and internal explosives have been simultaneously detonated at the center of case end 15 creating two detonation fronts 26 and 28. Covering 22 burns symmetrically over end 15 and causes covering 20 to ignite as shown by detonation front 26. Detonation front 28 is created as internal explosive 14 burns. Detonation products 24 are formed exerting forces, shown by the arrows, on material 18.

Referring to FIG. 1C, the internal explosive composition has been completely consumed and outer covering explosive 20 has burned substantially the entire length of case 12. It can be seen that case 12 has also been consumed by the burning processes and has become mixed with or part of the detonation products. As the covering explosive burns, the detonation products 24 form an envelope of pressurized gases around disruptive material 18. The pressure of the gases exerted on material 18 confines and holds the material to substantially its original shape. Some compression of the material occurs depending on the material used. The high pressure gases take the place of the now consumed case wall and present what is seen by material 18 as an infinitely thick wall resistance. The resistance presented by the gases keeps the material in a well defined shape and directs the material toward the liner and target.

Still referring to FIG. 1C a shockwave 30 is created by the explosive forces which is transmitted through material 18 toward the liner.

Now, referring to FIG. 1D, wherein the covering explosive has burned over substantially its entire length, it is seen that shockwave 30 has reached liner 16 causing the liner to begin to collapse and take its desired shape.

Detonation products envelope 24 encircles material 18 which is now being propelled along the longitudinal axis of the device toward the liner.

Figure 1E:
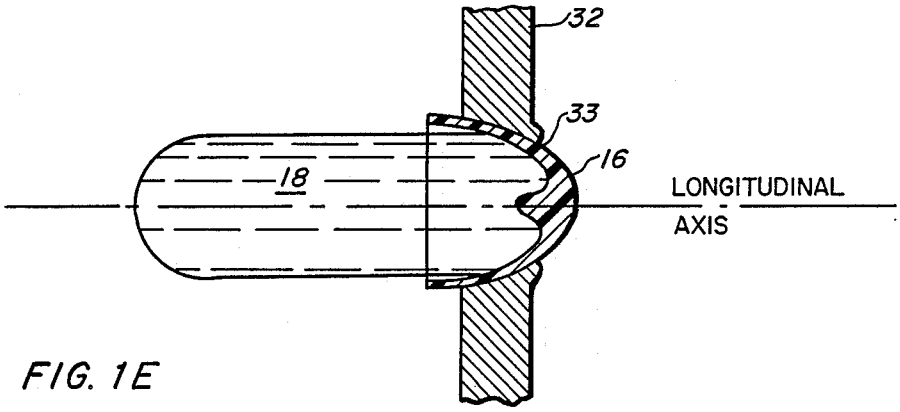
FIG. 1E is a cross-sectional diagramatic representation of the preferred embodiment in use after all explosive detonation has stopped showing a target being penetrated by the shaped charge and the target disruptive material confined and directed to be inserted into the target.
Figure 1F:
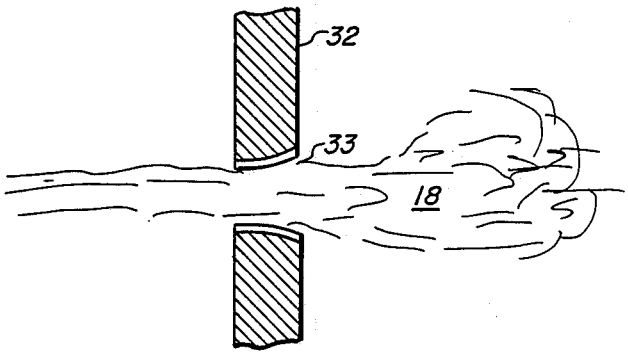
FIG. 1F is a transverse longitudinal cross-section showing the disruptive material driven through the target.

As shown on FIG. 1E, all combustion has been completed, the combustion products have dissipated and the shaped charge liner has formed and been propelled into the target. Disruptive material 18 has been confined to remain in a well defined shape and has been propelled and directed along the same trajectory as liner 16. Because material 18 is confined and directed, it resists enlargement perpendicular to its forward motion and will pass through perforation 33 without striking the outside surface of the target. Finally, as shown in FIG. 1F, the disruptive material is driven through the perforation made by the shaped charge liner.

It can be appreciated that gelatinous or low melting point particles, if used as the disruptive material, would liquidify or gasify under the heat of detonation and also be confined and propelled into the target perforation. Because the case is consumed during detonation into either gases or very fine non-metallic particles, no significant fragments therefrom will enter the target. Further, because the liner is non-metallic, any fragmentation thereof on impact with the target will not cause any activity within the target that would otherwise detonate an explosive therein had the liner been metallic. In practice it has been found that the plastic jet liner also has a tendency to deposit some of its material onto the walls of perforation 33 in target 32, thus helping to lessen the chance that metallic debris from the target itself might be driven beyond the target 32.

While this invention has been described as being a device for safely disarming unexploded bombs it is contemplated that the invention is also applicable to other uses such as ammunition mining, and for perforating casings such as those described in the background hereinabove. In practice, such an effect as enhanced explosion behind a wall has been achieved when material 18 has been an oil-based paint. Having described the details of the invention and its preferred mode of operation, those skilled in the art of shaped charges and explosives will readily be able to devise other embodiments and modifications, and said modifications and embodiments are to be considered to be within the scope of this invention.

I claim:

1. An explosive device for perforating the wall of a target and ejecting a liquid through the perforation for disrupting structure behind the target wall, comprising:

a hollow case formed of plastic material having two opposing ends, an inner surface and an outer surface, said case adapted to be substantially consumed by burning and be free of fragmentation when the device is detonated;

a shaped charge liner formed of plastic material in fluid-tight attachment with said case inner surface adjacent one end thereof and facing in an outward direction for placement toward a target to be perforated;

a first explosive contained within said case at the second end thereof;

a shockwave transmitting liquid material located in the case between the shaped charge liner and the first explosive, whereby, upon detonation, the first explosive creates high pressure gases the shockwave of which is transmitted through the liquid material for collapsing the shaped charge liner and causing it to perforate the target wall and cause the liquid material to follow through the perforation; and a second explosive in the form of a sheet completely covering the outer surface of the case and completely covering the second end of the case including the first explosive charge;

whereby, upon simultaneous detonation of the first and second explosives, forces exerted inwardly by the second explosive balance the outward forces of the first explosive to prevent their radial expansion and expansion toward second end to confine its forces in the direction of the shaped charge liner, thereby confining said liquid material to a well defined shape and causing substantially all of said material to pass through the wall perforation.

* * * * *